US010050365B1

(12) United States Patent
Ju

(10) Patent No.: US 10,050,365 B1
(45) Date of Patent: Aug. 14, 2018

(54) ELECTRICAL CONNECTOR ASSEMBLY

(71) Applicant: LOTES CO., LTD, Keelung (TW)

(72) Inventor: Ted Ju, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 15/802,864

(22) Filed: Nov. 3, 2017

(30) Foreign Application Priority Data

May 3, 2017 (CN) ..... 2017 1 0302747

(51) Int. Cl.

| | |
|---|---|
| ***H01R 4/66*** | (2006.01) |
| ***H01R 13/02*** | (2006.01) |
| ***H01R 13/648*** | (2006.01) |
| ***H01R 13/516*** | (2006.01) |
| *H01R 24/00* | (2011.01) |

(52) U.S. Cl.
CPC ..... *H01R 13/02* (2013.01); *H01R 13/516* (2013.01); *H01R 13/648* (2013.01); *H01R 24/00* (2013.01)

(58) Field of Classification Search
CPC .. H01R 13/02; H01R 13/6585; H01R 13/516; H01R 13/648; H01R 24/00; H01R 24/70; H01R 24/62
See application file for complete search history.

(56) References Cited

U.S. PATENT DOCUMENTS

| | | | | |
|---|---|---|---|---|
| 9,525,244 | B1 * | 12/2016 | Hsu | H01R 13/6585 |
| 9,614,333 | B2 * | 4/2017 | Tsai | H01R 24/70 |
| 9,735,522 | B2 * | 8/2017 | Chen | H01R 24/62 |
| 9,853,399 | B2 * | 12/2017 | Kao | H01R 13/6585 |
| 2016/0149348 | A1 * | 5/2016 | Kao | H01R 13/6585 439/607.05 |
| 2016/0172790 | A1 * | 6/2016 | Chen | H01R 24/62 439/607.01 |
| 2016/0329667 | A1 * | 11/2016 | Tsai | H01R 24/70 |

FOREIGN PATENT DOCUMENTS

| | | |
|---|---|---|
| CN | 2665984 Y | 12/2004 |
| CN | 202633669 U | 12/2012 |

* cited by examiner

*Primary Examiner* — Jean F Duverne
(74) *Attorney, Agent, or Firm* — Locke Lord LLP; Tim Tingkang Xia, Esq.

(57) ABSTRACT

An electrical connector assembly includes an electrical connector and a mating connector. The electrical connector includes a base and a tongue extending forward from the base. A first signal terminal is fixedly provided on the base and exposed to the surface of the tongue. A metal shell is sleeved over the base and the tongue to form an insertion space between the metal shell and the tongue. The mating connector includes a plastic seat body. A second signal terminal is fixedly provided on the plastic seat body and extending into a mating space. A grounding elastic member is fixedly provided on a wall portion and exposed to the mating space. In the first mating state, the second signal terminal is not in contact with the first signal terminal. In the second mating state, and the second signal terminal is in contact with the first signal terminal.

20 Claims, 14 Drawing Sheets

A-A

B–B

ELECTRICAL CONNECTOR ASSEMBLY

CROSS-REFERENCE TO RELATED APPLICATION

This non-provisional application claims priority to and the benefit of, pursuant to 35 U.S.C. § 119(a), Patent Application Serial No. 201710302747.6 filed in P.R. China on May 3, 2017, the entire content of which is hereby incorporated by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE INVENTION

The present invention relates to an electrical connector assembly and more particularly to an electrical connector assembly insertable forwardly and reversely.

BACKGROUND OF THE INVENTION

With the development of an electronic industry, requirements for the insertion and pulling performances of interface-type electrical connector assemblies are enhanced gradually to adapt to market demands. An existing electrical connector assembly includes an electrical connector and a mating connector, mated with each other. The electrical connector is installed on a circuit board, and includes an insulating body having has a tongue; multiple signal terminals are fixed to the insulating body and exposed to the surface of the tongue; and a metal shell covering around the tongue to form an insertion space. The mating connector includes a plastic main body, multiple mating terminals fixed to the plastic main body, a grounding elastic member installed on an outer wall surface of the plastic main body, and a shielding shell sleeving over the plastic main body. The grounding elastic member is in contact with the shielding shell. A front end of the plastic main body protrudes out of the shielding shell, that is, the shielding shell does not completely cover the front end part of the plastic main body. At the beginning of insertion of the mating connector into the insertion space, the plastic main body protrudes out of the shielding shell, such that the shielding shell cannot be in immediate contact with the metal shell to be grounded. Thus, the grounding elastic member cannot be grounded in time at the beginning of insertion of the mating connector into the insertion space. Since a gap exists between the mating connector and the electrical connector during insertion, the mating connector is prone to inclined insertion into the insertion space, such that the grounding elastic member may be easily in contact with the signal terminals to cause a short circuit, thereby burning the signal chip on the circuit board down, and seriously affecting the electrical connection between the electrical connector and the mating connector.

Therefore, a heretofore unaddressed need to design a novel electrical connector assembly exists in the art to address the aforementioned deficiencies and inadequacies.

SUMMARY OF THE INVENTION

An objective of the present invention is to provide an electrical connector assembly, where in a first mating state, a shielding shell and a metal shell are in contact, and a gap is provided between a grounding elastic member and a first signal terminal to avoid short circuiting of the first signal terminals, thereby ensuring a good electrical connection between an electrical connector and a mating connector.

To achieve the foregoing objective, one aspect of the invention provides an electrical connector assembly, which includes: an electrical connector, including an insulating body, the insulating body having a base and a tongue extending forward from the base, wherein at least one first signal terminal is fixedly provided on the base and exposed to a surface of the tongue, a metal shell is sleeved over the base and the tongue, an insertion space is formed between the metal shell and the tongue, and the at least one first signal terminal is exposed to the insertion space; and a mating connector, comprising a plastic seat body, the plastic seat body having a mating space, wherein a wall portion is provided at one side of the mating space, at least one second signal terminal is fixedly provided on the plastic seat body and extending into the mating space, a grounding elastic member is fixedly provided on the wall portion and exposed to the mating space, a shielding shell is sleeved over the plastic seat body, and the grounding elastic member is in contact with the shielding shell, wherein the electrical connector is provided with a first mating state and a second mating state when being mated with the mating connector along a mating direction, wherein in the first mating state, the shielding shell partially enters the insertion space, the shielding shell is conductive to the metal shell, a gap is provided between the grounding elastic member and the at least one first signal terminal, and the at least one second signal terminal is not in contact with the at least one first signal terminal; and wherein in the second mating state, the tongue is inserted into the mating space, the shielding shell is conductive to the metal shell, and the at least one second signal terminal is in contact with the at least one first signal terminal.

In certain embodiments, the insulating body is provided with a step portion between the base and the tongue, a thickness of the step portion is greater than a thickness of the tongue, a grounding sheet covers a surface of the step portion, and the grounding sheet is in contact with the metal shell, wherein in the second mating state, the grounding sheet is located in the mating space and is in contact with the grounding elastic member.

In certain embodiments, the grounding sheet has a fixing portion fixed to the base; an extending sheet extends forward from the fixing portion integrally and is exposed to the surface of the step portion; at least one through hole is formed by penetrating through the wall portion along a thickness direction thereof; a front end of the grounding elastic member has at least one elastic portion passing through the through hole and exposed to the mating space; in the first mating state, the mating space and the insertion space are partially overlapped, and the elastic portion is not in contact with the extending sheet; and in the second mating state, the elastic portion elastically urges against the extending sheet.

In certain embodiments, the fixing portion is insert-molded into the base; two extending sheets extend forward from an upper side and a lower side of the fixing portion and are exposed to an upper surface and a lower surface of the step portion, respectively; the plastic seat body is provided with two wall portions at two opposite sides of the mating space respectively; two grounding elastic members are installed at outer sides of the two wall portions, respectively; and in the second mating state, the elastic portions of the two grounding elastic members pass through the through holes respectively and elastically clamp the two extending sheets along a vertical direction.

In certain embodiments, the front end of the grounding elastic member is provided with at least one first grounding portion, and the at least one first grounding portion is located between two adjacent ones of the elastic portions; a rear end of the grounding elastic member is provided with a plurality of second grounding portions; and the at least one first grounding portion and each of the second grounding portions are formed by extending obliquely toward a direction away from the mating space respectively, and are in contact with the shielding shell.

In certain embodiments, the mating connector has at least two pairs of second signal terminals arranged in a same row, and each of the second signal terminals is a differential signal terminal; the grounding elastic member has three elastic portions arranged side by side and protruding into the mating space; and two elastic portions located at two sides of the grounding elastic member are correspondingly located right ahead of the two pairs of second signal terminals along the mating direction.

In certain embodiments, the mating connector further includes at least one pair of low-speed signal terminals fixedly provided on the plastic seat body and extending into the mating space, the low-speed signal terminals are located between the two pairs of second signal terminals, and the elastic portion at a middle position of the grounding elastic member is located right ahead of the low-speed signal terminals along the mating direction.

In certain embodiments, an opening hole is provided on a top wall of the metal shell; an elastic arm is formed by extending forward from a rear edge of the opening hole integrally along the mating direction and bending toward the insertion space; the elastic arm protrudes into the insertion space; a central line of the elastic arm along the mating direction coincides with a central line of the top wall of the metal shell along the mating direction; and in the first mating state and the second mating state, the elastic arm is in contact with the shielding shell.

In certain embodiments, the top wall of the metal shell is provided with at least one protruding portion protruding toward the insertion space at each of two sides of the elastic arm, and a front end of the protruding portion extends forward beyond a front end of the elastic arm along the mating direction.

In certain embodiments, the protruding portion is a strip-shaped rib, and a length of the protruding portion along the mating direction is greater than a length of the elastic arm along the mating direction.

In certain embodiments, the top wall of the metal shell is provided with two protruding portions protruding toward the insertion space at each of two sides of the elastic arm, each of the protruding portions is bulged, and a distance between the two protruding portions at a same side of the elastic arm is greater than a length of the elastic arm.

In certain embodiments, a periphery of a front end of the shielding shell bends toward the mating space to form a flange, an outer surface of the plastic seat body is concavely provided with a concave portion, the flange is correspondingly located in the concave portion, a front end surface of the flange extends forward beyond a front end surface of the plastic seat body along the mating direction, and in the second mating state, the front end surface of the flange urges against a front end surface of the base.

In certain embodiments, at least one electrical conductor is provided on an outer wall surface of the shielding shell, and in the first mating state, the at least one electrical conductor enters the insertion space and is in contact with the metal shell.

In certain embodiments, the outer wall surface of the shielding shell comprises a top surface and a bottom surface opposite to each other, and two side surfaces respectively connected to the top surface and the bottom surface; the at least one electrical conductor comprises two electrical conductors, and each of the top surface and the bottom surface is provided with one of the two electrical conductors; a hardness of each of the two electrical conductors is smaller than a hardness of the shielding shell; and a front end of each of the two electrical conductors extends forward beyond a front end of the grounding elastic member along the mating direction.

In certain embodiments, the two electrical conductors are adhered to the top surface and the bottom surface of the shielding shell, and each of the electrical conductors is formed by conductive flexible glue or a conductive sponge.

In certain embodiments, the electrical conductor is a metal elastic member or a metal ring, a front end of the electrical conductor extends forward beyond a front end of the grounding elastic member along the mating direction, and the electrical conductor is soldered or sleeved onto the outer wall surface of the shielding shell.

In certain embodiments, the electrical connector has four pairs of first signal terminals arranged on an upper surface and a lower surface of the tongue respectively to form an upper row and a lower row, and each of the first signal terminals is a differential signal terminal; at least one first ground terminal is provided at an outermost side of the first signal terminals in each row of the electrical connector; each of the first signal terminals in each row and the at least one first ground terminal have a flat contact portion exposed to the insertion space, respectively; a middle shielding member is insert-molded into the tongue and located between the first signal terminals in the upper row and the lower row; and two side edges of the middle shielding member are respectively concavely provided with buckling portions protruding out of two opposite sides of the tongue.

In certain embodiments, the mating space is concavely provided backward from a front end of the plastic seat body; the mating connector has four pairs of second signal terminals fixedly provided on the plastic seat body and arranged at an upper side and a lower side of the mating space respectively to form an upper row and a lower row; a second ground terminal is provided at an outer side of each pair of second signal terminals of the mating connector, and is fixedly provided on the plastic seat body and protrudes into the mating space; each of the second signal terminals and each second ground terminal have an elastic contact portion located in the mating space respectively; a latch member is installed on the plastic seat body and located between the second signal terminals in the upper row and the lower row; the latch member has a pair of elastic latch portions extending along the mating direction and entering the mating space; and in the second mating state, the elastic contact portions in the upper row and the lower row are in one-to-one corresponding contact with the flat contact portions in the upper row and the lower row, and the latch portions are correspondingly buckled to the buckling portions.

In certain embodiments, the plastic seat body is provided with two wall portions at the upper side and lower side of the mating space respectively; each of the two wall portions is provided with a plurality of terminal slots penetrating therethrough along a thickness direction thereof and communicated with the mating space; in the second mating state, the elastic contact portions are correspondingly accommodated in the terminal slots; two grounding elastic members are respectively installed on the two wall portions, and each of the two grounding elastic members is provided with a reserved hole corresponding to the terminal slots of each of the two wall portions; and front ends of the elastic contact portions are exposed to the reserved holes.

In certain embodiments, the elastic contact portion of each of the second ground terminals is accommodated in the terminal slot at an outermost side of each wall portion, each grounding elastic member has two connecting portions provided at two sides of the reserved hole thereof to cover the terminal slot at the outermost side of each wall portion, and the second ground terminals and the connecting portions are overlapped in the thickness direction of each wall portion.

Compared with the art, certain embodiments of the invention have the following beneficial advantages: the electrical connector is in a first mating state and a second mating state when being mated with the mating connector along a mating direction. In the first mating state, the shielding shell partially enters the insertion space, the shielding shell is conductive to the metal shell, a gap is provided between the grounding elastic member and the first signal terminal, and the second signal terminal is not in contact with the first signal terminal. That is, the shielding shell can be conductive to the metal shell in the first mating state, thereby grounding the shielding shell, and the grounding elastic member is in contact with the shielding shell so as to be grounded in time in the first mating state. Even if the grounding elastic member is in contact with the signal terminals due to inclined insertion of the mating connector into the insertion space, the grounding elastic member has been grounded and a gap is provided between the grounding elastic member and the first signal terminal, thus preventing the first signal terminal from short-circuiting and a signal chip on the circuit board from being burnt down. In the second mating state, the tongue is inserted into the mating space, the shielding shell is conductive to the metal shell, and the second signal terminal is in contact with the first signal terminal, thus enabling a good electrical connection between the electrical connector and the butting connector.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
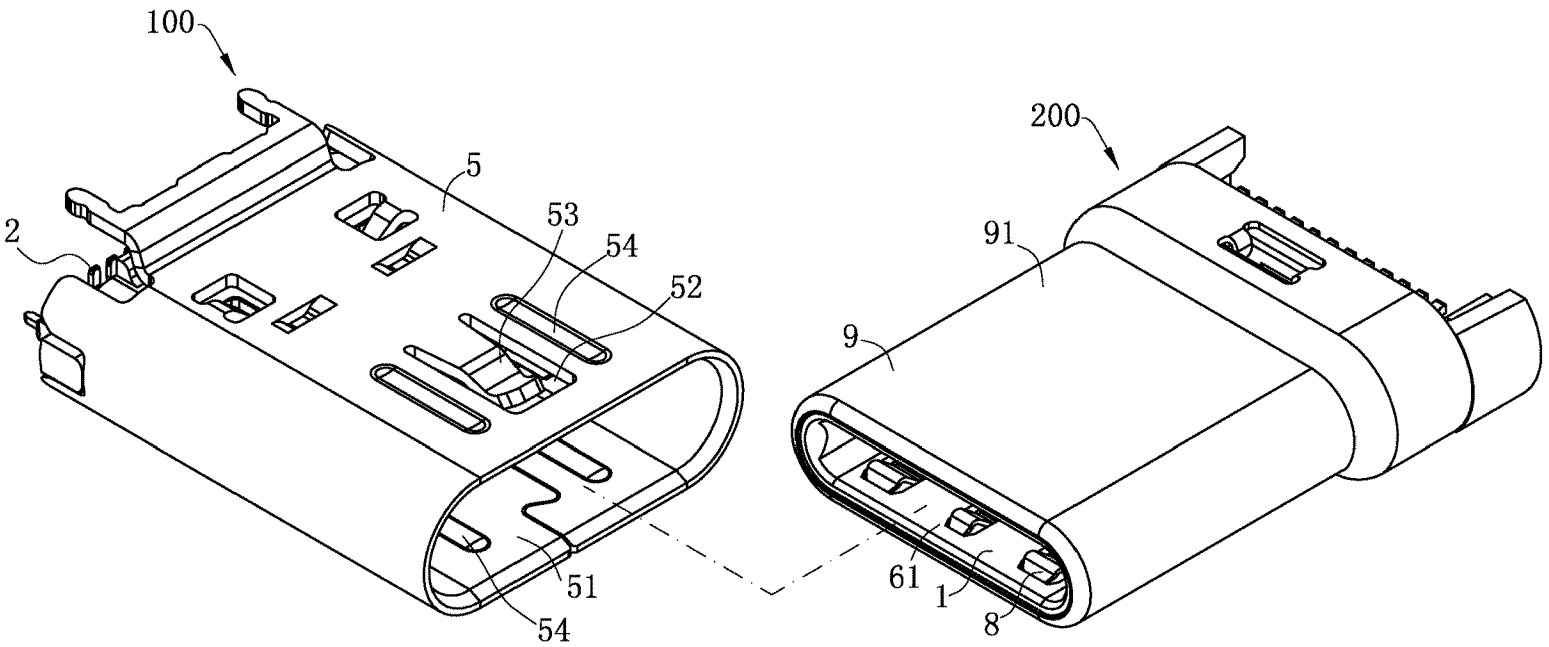
FIG. 1 is a three-dimensional schematic view of an electrical connector not mated with a mating connector in an electrical connector assembly according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-14. In accordance with the purposes of this invention, as embodied and broadly described herein, this invention, in one aspect, relates to an electrical connector assembly.

Figure 7:
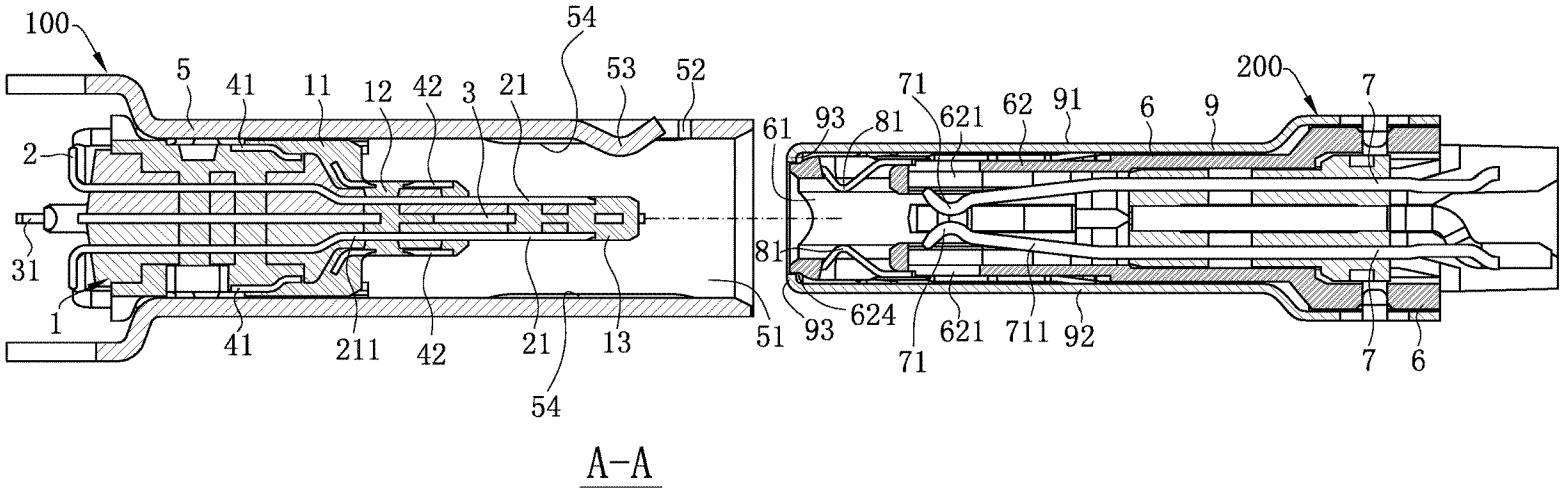
FIG. 7 is a sectional view in a direction A-A in FIG. 6.
Figure 8:
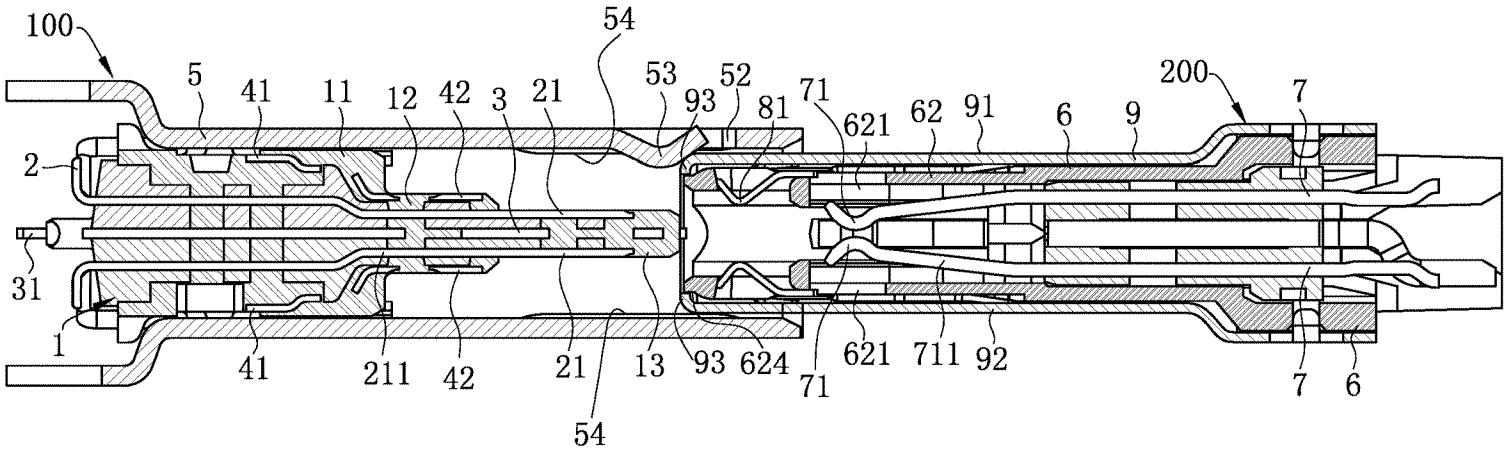
FIG. 8 is a schematic view of the electrical connector and the mating connector in a first mating state in the electrical connector assembly according to one embodiment of the present invention.

As shown in FIG. 1, FIG. 7 and FIG. 8, an electrical connector assembly according to certain embodiments of the present invention includes an electrical connector 100 and a mating connector 200 mated with the electrical connector 100. The electrical connector 100 includes an insulating body 1, which has a base 11 and a tongue 13 extending forward from the base 11. Multiple first terminals 2 are fixedly provided on the base 11 and extend into the tongue 13, and the first terminals 2 include at least one first signal terminal 211. A metal shell 5 is sleeved over the base 11 and the tongue 13. The mating connector 200 includes a plastic seat body 6, which has a mating space 61. A wall portion 62 is provided at one side of the mating space 61. Multiple second terminals 7 are fixedly provided on the plastic seat body 6 and extend into the wall portion 62, and the second terminals 7 include at least one second signal terminal 711. A grounding elastic member 8 is fixedly provided on the wall portion 62, and the grounding elastic member 8 is exposed to the mating space 61. A shielding shell 9 is sleeved over the plastic seat body 6, and the grounding elastic member 8 is in contact with the shielding shell 9. The electrical connector 100 is provided with a first mating state and a second mating state when being mated with the mating connector 200 along a mating direction. In the first mating state, the shielding shell 9 partially enters an insertion space 51, the shielding shell 9 is conductive to the metal shell 5, a gap is provided between the grounding elastic member 8 and the first signal terminal 211, and the second signal terminal 711 is not in contact with the first signal terminal 211. In the second mating state, the tongue 13 is inserted into the mating space 61, the shielding shell 9 is conductive to the metal shell 5, and the second terminals 7 are in contact with the first terminals 2. That is, the second signal terminal 711 is in contact with the first signal terminal 211 to form an electrical connection.

Figure 2:
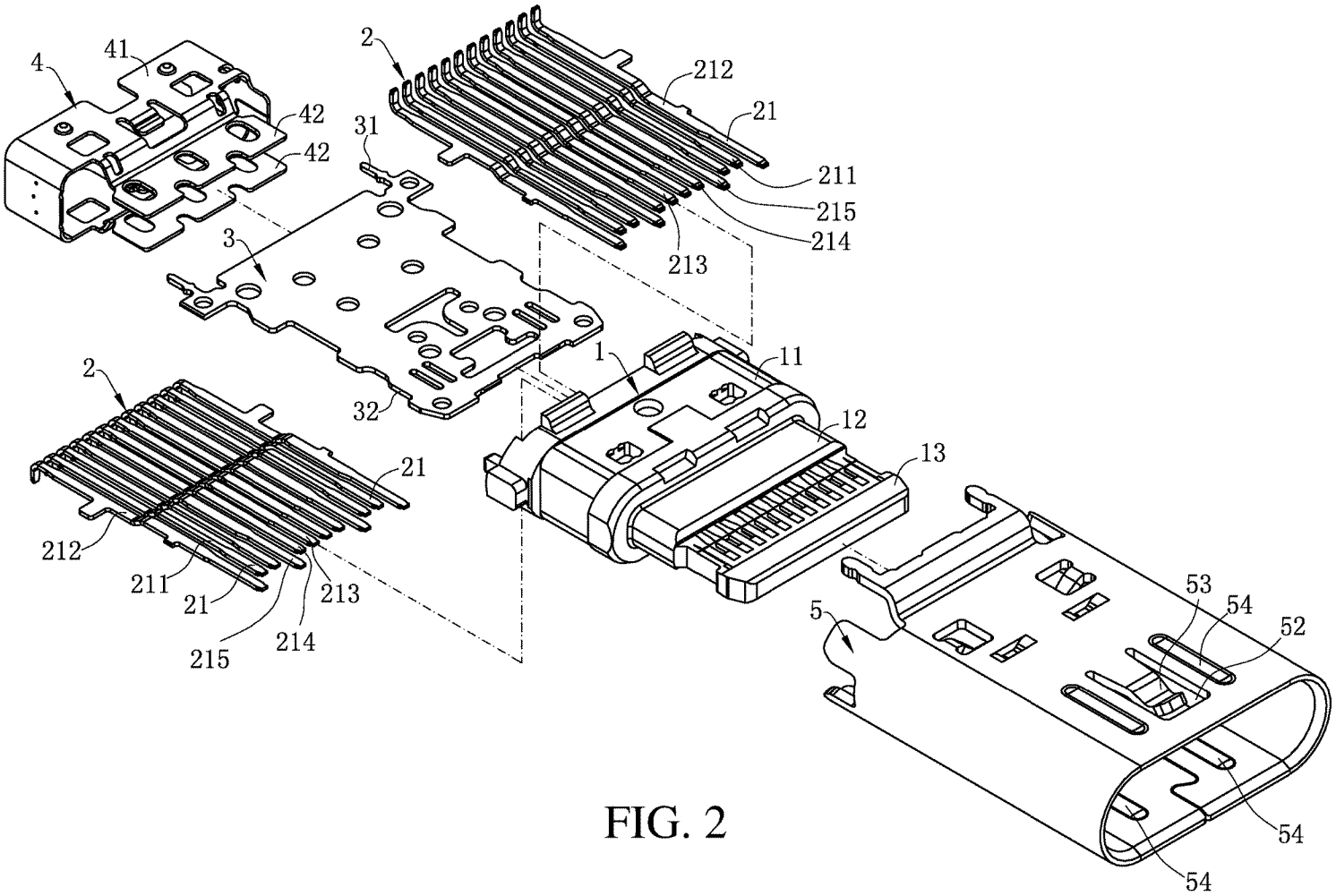
FIG. 2 is a three-dimensional exploded view of the electrical connector according to one embodiment of the present invention.
Figure 3:
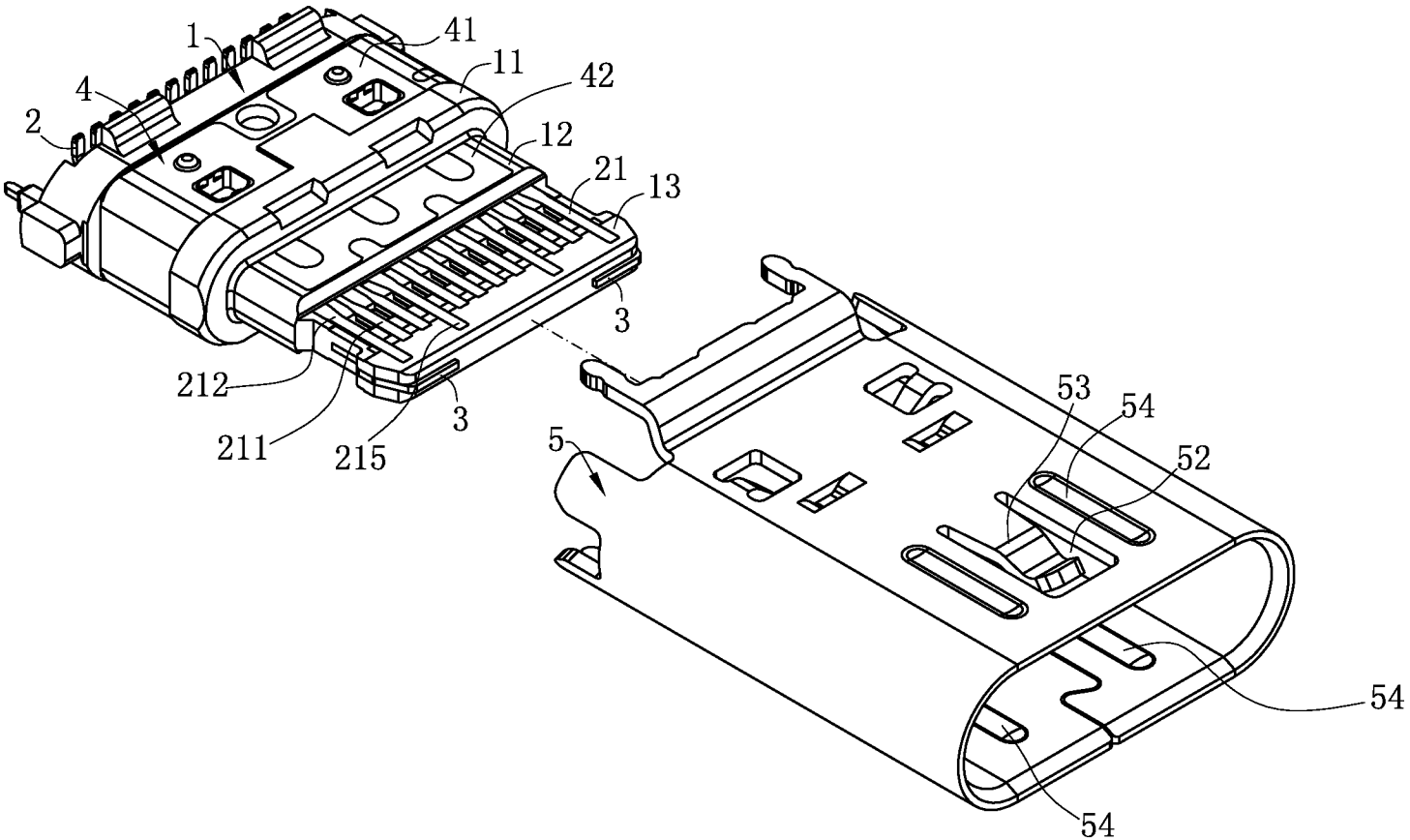
FIG. 3 is a local assembled view of the electrical connector according to one embodiment of the present invention.

As shown in FIG. 1, FIG. 2 and FIG. 3, the electrical connector 100 is configured to be vertically installed on a circuit board (not shown), and includes an insulating body 1 and multiple first terminals 2 fixedly provided on the insulating body 1. The insulating body 1 has a base 11 located at its rear end and a tongue 13 extending forward from the base 11, and is provided with a step portion 12 between the base 11 and the tongue 13. A thickness of the step portion 12 is greater than that of the tongue 13 and smaller than that of the base 11. The first terminals 2 are fixedly provided on the base 11 and extend into the tongue 13, and are exposed to a surface of the tongue 13 respectively so as to be conveniently mated with the mating connector 200. The first terminals 2 are arranged on the upper and lower surfaces of the tongue 13 respectively to form an upper row and a lower row. In the present embodiment, each first signal terminal 211 is a high-speed differential signal terminal used for transmitting a universal serial bus (USB) 3.0 signal, and the electrical connector 100 has four pairs of first signal terminals 211 that are arranged on the upper and lower surfaces of the tongue 13 respectively and together with other terminals of the first terminals 2 to form an upper row and a lower row. The first terminals 2 in the upper row and the first terminals 2 in the lower row are disposed in a central symmetry manner around a center of the tongue 13. In other embodiments, the first signal terminals 211 may be terminals for transmitting other signals, and there may be one or more first signal terminals 211. In the present embodiment, there are twelve first terminals 2 in the upper row and twelve first terminals 2 in the lower row, arranged in the same sequential order. The first terminals 2 in each row include two pairs of first signal terminals 211, a pair of first low-speed terminals 213 located between the two pairs of first signal terminals 211, a first reserved terminal 214 and a first power terminal 215 located between each first low-speed terminal 213 and each first signal terminal 211, and a first ground terminal 212 located at the outer side of each first signal terminal 211. The first low-speed terminals 213 are used for transmitting USB 2.0 signals. Each first terminal 2 has a flat contact portion 21. That is, each first signal terminal 211 has a flat contact portion 21. The flat contact portions 21 of the first terminals 2 in the upper row are exposed to the upper surface of the tongue 13, and the flat contact portions 21 of the first terminals 2 in the lower row are exposed to the lower surface of the tongue 13. Further, the flat contact portions 21 of the first signal terminals 211 are distributed on the upper and lower surfaces of the tongue 13 respectively.

As shown in FIG. 1, FIG. 2 and FIG. 3, a middle shielding member 3 is insert-molded into the tongue 13 and located between the first signal terminals 2 in the upper row and the lower row, configured to shield signal interferences between the first signal terminals 211 in the upper row and the lower row. Two soldering pins 31 are formed at intervals by extending from the rear end of the middle shielding member 3, configured to be soldered to the circuit board. Two side edges of the middle shielding member 3 are respectively concavely provided with buckling portions 32 protruding out of two opposite sides of the tongue 13. A grounding sheet 4 covers a surface of the step portion 12, and the grounding sheet 4 is in contact with the metal shell 5. The grounding sheet 4 has a fixing portion 41 fixed to the base 11, and an extending sheet 42 extends forward from the fixing portion 41 and is exposed to the surface of the step portion 12. In the present embodiment, the grounding sheet 4 and the insulating body 1 are insert-molded integrally. Specifically, the fixing portion 41 is ring-shaped, and is insert-molded into the base 11. The first ground terminals 212 located on the upper and lower surfaces of the tongue 13 and the middle shielding member 3 in the middle of the tongue 13 are in mechanical contact with the side wall surface of the fixing portion 41 respectively to ground the grounding sheet 4, thus enhancing the shielding effect of the electrical connector 100 as a whole. Two extending sheets 42 extend forward from an upper side and a lower side of the fixing portion 41 respectively, and the two extending sheets 42 are exposed to the upper and lower surfaces of the step portion 12 respectively.

As shown in FIG. 1, FIG. 2 and FIG. 3, the metal shell 5 covers the base 11 and the tongue 13, and an insertion space 51 is formed between an inner wall surface of the metal shell 5 and an outer surface of the tongue 13. The flat contact portion 21 of each first terminal 2 is exposed to the insertion space 51. That is, the flat contact portion 21 of each first signal terminal 211 is exposed to the insertion space 51. The insertion space 51 is provided for allowing insertion of the mating connector 200. In the present embodiment, an opening hole 52 is provided on a top wall of the metal shell 5, and an elastic arm 53 is formed by extending forward from a rear edge of the opening hole 52 integrally along the mating direction and bending toward the insertion space 51. The elastic arm 53 protrudes into the insertion space 51, and a distance between the elastic arm 53 and the flat contact portion 21 is smaller than a distance between the top wall of the metal shell 5 and the flat contact portion 21 to ensure that the elastic arm 53 urges against the mating connector 200. A central line of the elastic arm 53 along the mating direction coincides with a central line of the top wall of the metal shell 5 along the mating direction. That is, the elastic arm 53 is located at a middle position of the metal shell 5. Even if the mating connector 200 is inserted into the insertion space 51 along a deviated insertion direction, it can be ensured that the elastic arm 53 is into contact with the shielding shell 9 of the mating connector 200 smoothly. The top wall of the metal shell 5 is provided with at least one protruding portion 54 protruding toward the insertion space 51 at each of two sides of the elastic arm 53. Each protruding portion 54 extends forward beyond a front end of the elastic arm 53 along the mating direction. During mating with the mating connector 200, the shielding shell 9 of the mating connector 200 is in contact with the protruding portions 54 of the metal shell 5, and is guided by the protruding portions 54 to be in contact with the elastic arm 53. Thus, the protruding portions 54 are provided for good positioning of the shielding shell 9 of the mating connector 200 in the insertion space 51, thereby preventing the elastic arm 53 from being damaged in a direct contact between the shielding shell 9 of the mating connector 200 and the tail end of the elastic arm 53. In the present embodiment, each protruding portion 54 is a strip-shaped rib, and the length of the protruding portion 54 along the mating direction is greater than a length of the elastic arm 53 along the mating direction. In another embodiment, the top wall of the metal shell 5 is provided with two protruding portions 54 protruding toward the insertion space 51 at each of the two sides of the elastic arm 53. Each protruding portion 54 is bulged, and a distance between the two protruding portions 54 at the same side of the elastic arm 53 is greater than a length of the elastic arm 53. In other embodiments, multiple protruding portions 54 may be provided, as long as it is ensured that the front end of at least one of the protruding portions 54 extends forward beyond the front end of the elastic arm 53. In the present embodiment, a bottom wall of the metal shell 5 is also provided with two protruding portions 54, thereby better guiding the shielding shell 9 of the mating connector 200 to be inserted into the insertion space 51.

Figure 4:
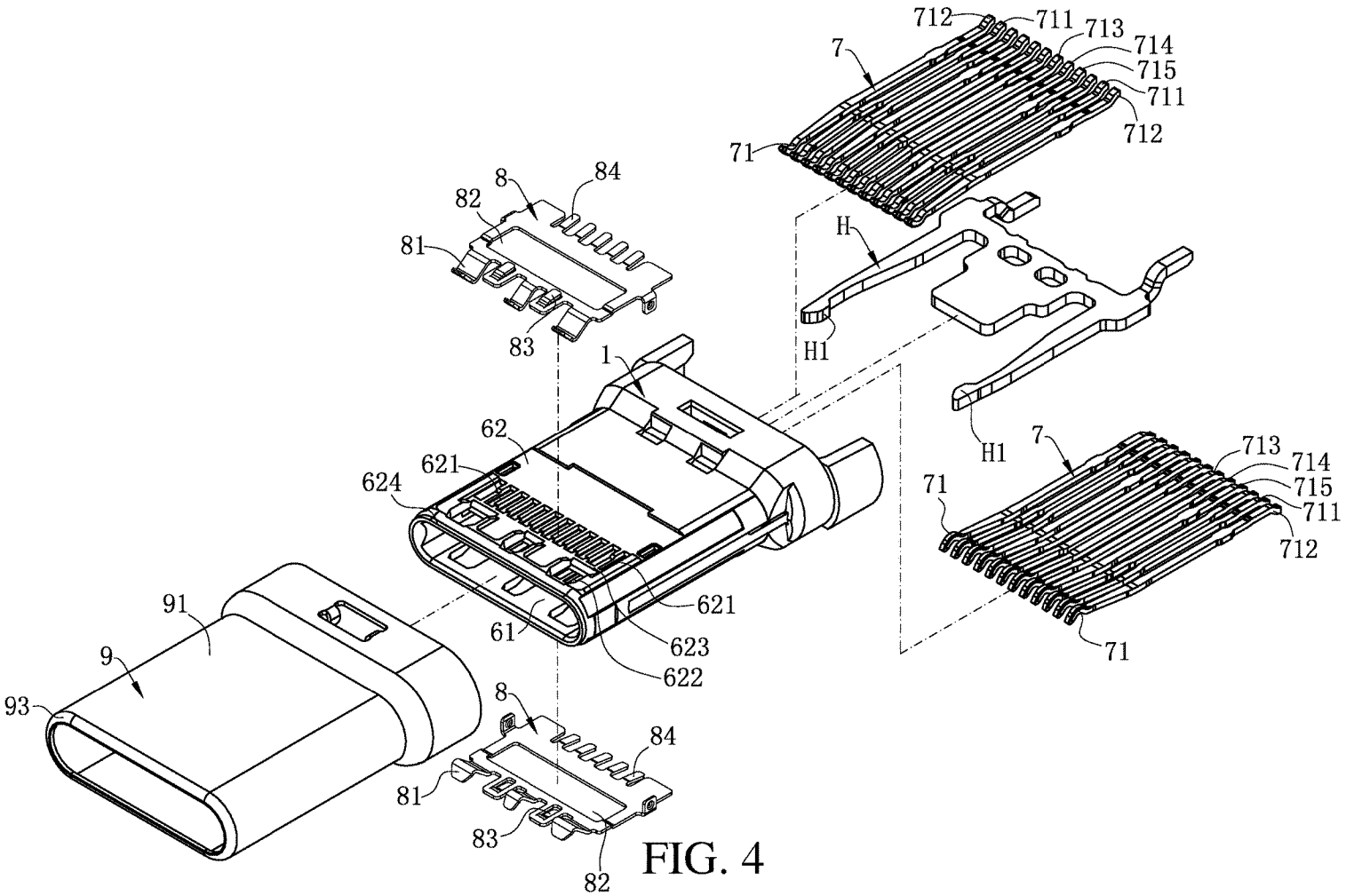
FIG. 4 is a three-dimensional exploded view of the mating connector according to one embodiment of the present invention.
Figure 5:
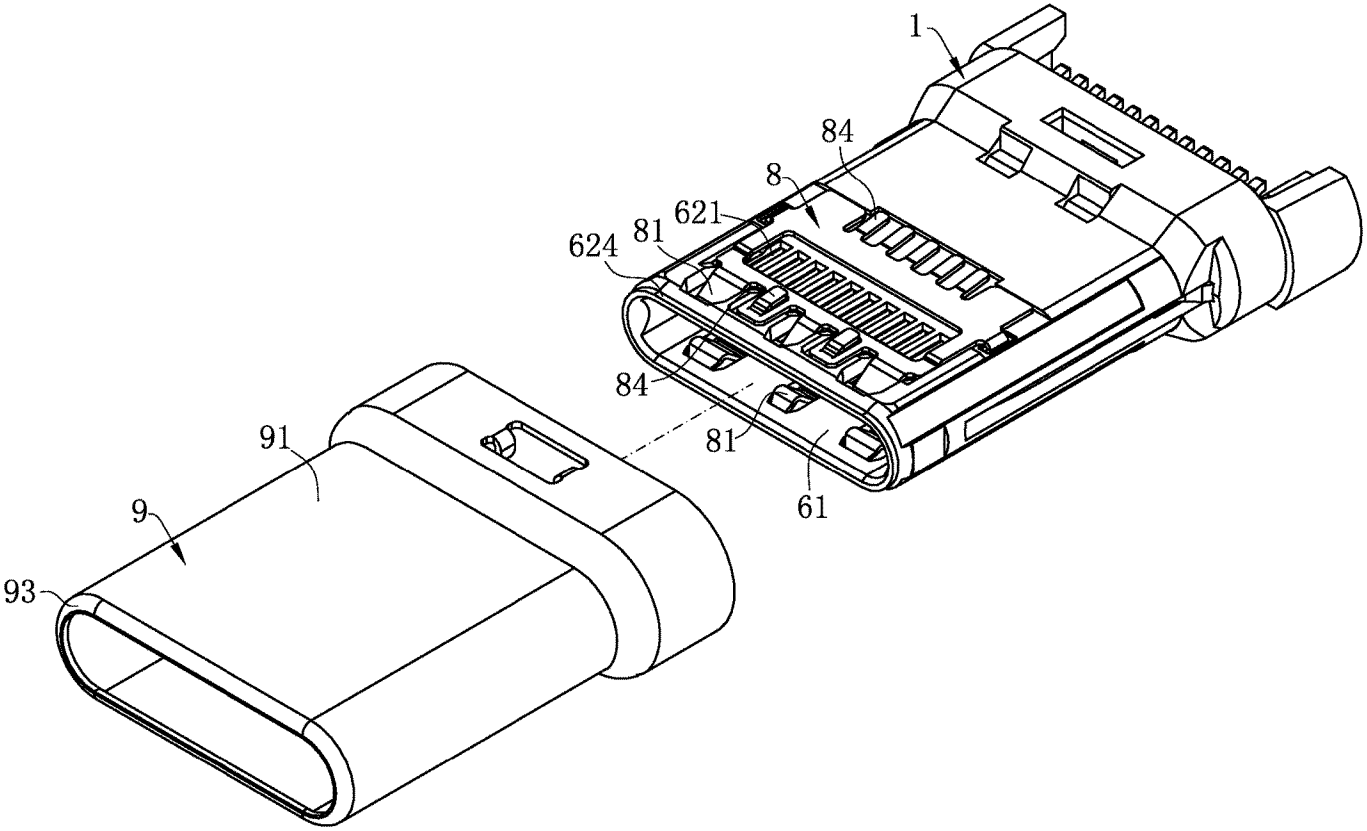
FIG. 5 is a local assembled view of the mating connector according to one embodiment of the present invention.

As shown in FIG. 1, FIG. 4 and FIG. 5, the mating space 61 is concavely formed backward from the front end of the plastic seat body 6. Two wall portions 62 are provided at the upper and lower sides of the mating space 61 respectively. Multiple second terminals 7 are arranged at the upper and lower sides of the mating space 61 respectively to form an upper row and a lower row, and the second terminals 7 in the upper row and the second terminals 7 in the lower row are disposed in a central symmetry manner around a center of the mating space 61, such that the mating connector 200 can be in forward and reverse insertion connections with the electrical connector 100. In the present embodiment, there are twelve second terminals 7 in the upper row and twelve second terminals 7 in the lower row, arranged in the same sequential order. At least one second signal terminal 711 is provided in the second terminals 7 in each row, and each second signal terminal 711 is a differential signal terminal used for transmitting a USB 3.0 signal. The mating connector 200 has at least two pairs of second signal terminals 711, and the two pairs of second signal terminals 711 are arranged in the same row. In the present embodiment, the second terminals 7 in each row only include two pairs of second signal terminals 711, and the second terminals 7 in each row further include a pair of second low-speed terminals 713 located between the two pairs of second signal terminals 711, a second reserved terminal 714 and a second power terminal 715 located between each second low-speed terminal 713 and each second signal terminal 711, and a second ground terminal 712 located at the outer side of each second signal terminal 711. The second low-speed terminals 713 are used for transmitting USB 2.0 signals. In other embodiments, the second signal terminals 711 may be terminals for transmitting other signals, and there may be one or more second signal terminals 711, as long as it is ensured that the number of the second signal terminals is matched with the number of the first signal terminals 211. A front end of each second terminal 7 has an elastic contact portion 71 extending into the mating space 61, and a rear end of each second terminal 7 protrudes out of the plastic seat body 6. A latch member H is installed on the plastic seat body 6 and located between the second terminals 7 in the upper and lower rows, and a pair of elastic latch portions H1 extends from the latch member H along the mating direction and enters the mating space 61.

As shown in FIG. 1, FIG. 4 and FIG. 5, each wall portion 62 is provided with multiple terminal slots 621 penetrating therethrough along a thickness direction thereof and communicated with the mating space 61. When the tongue 13 enters the mating space 61, the elastic contact portions 71 will be pushed to correspondingly enter the terminal slots 621. Thus, the terminal slots 621 are used for providing elastic displacement spaces of the elastic contact portions 71 to ensure that the mating connector 200 and the electrical connector 100 are smoothly mated. At least one through hole 622 is formed by penetrating through each wall portion 62 along a thickness direction thereof. The through hole 622 is communicated with the mating space 61, and a beam 623 is provided between the through hole 622 and the terminal slots 621, such that the through hole 622 is not communicated with the terminal slots 621. Two grounding elastic members 8 are respectively installed at the outer side of the two wall portions 62, and are used for shielding signal interferences at the outer side of the second terminal 7. In the present embodiment, a front end of each grounding elastic member 8 is provided with multiple elastic portions 81, and each wall portion 62 is correspondingly provided with multiple independent through holes 622 for accommodating the elastic portions 81. In other embodiments, there may be one elastic portion 81 and one through hole 622. In the present embodiment, specifically, the front end of the grounding elastic member 8 is provided with three elastic portions 81 that are disposed side by side, and each wall portion 62 is provided with three independent through holes 622 in front of the terminal slots 621 and penetrating therethrough. The three elastic portions 81 are correspondingly accommodated in the three through holes 622 and exposed to the mating space 61 respectively. The three elastic portions 81 include two elastic portions 81 located at two sides of the grounding elastic member 8 and one elastic portion 81 located at a middle position of the grounding elastic member 8. The two elastic portions 81 located at the two sides of the grounding elastic member 8 are correspondingly located right ahead of the two pairs of second signal terminals 711 along the mating direction, and used for shielding signal interferences at the outer sides of the two pairs of second signal terminals 711. The elastic portion 81 at the middle position of the grounding elastic member 8 is located right ahead of the second low-speed signal terminals 713 along the mating direction, and used for shielding signal interferences at the outer sides of the second low-speed signal terminals 713.

Figure 6:
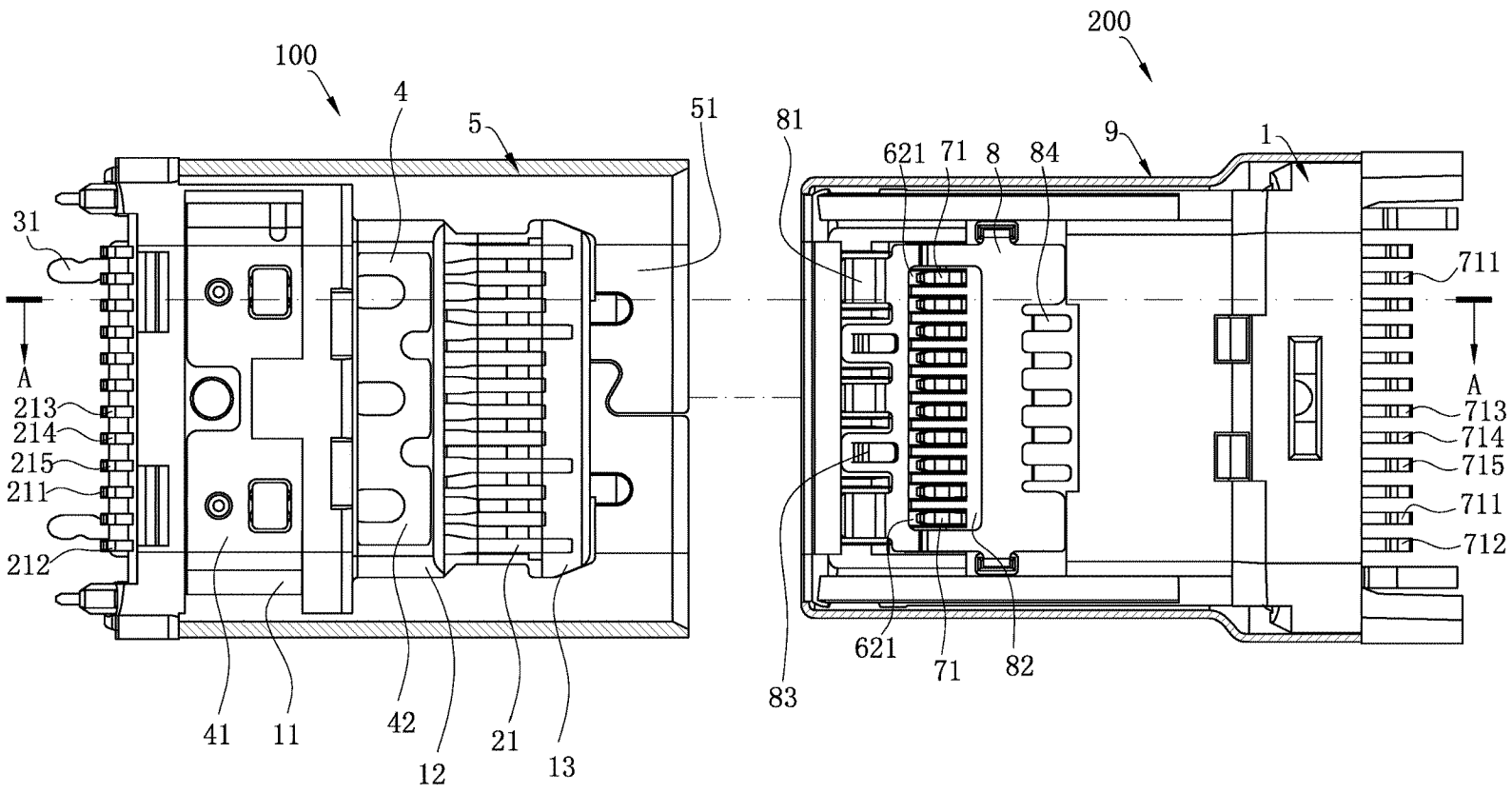
FIG. 6 is a structural schematic view of the electrical connector not mated with the mating connector in the electrical connector assembly according to one embodiment of the present invention from another viewing angle.

As shown in FIG. 4, FIG. 5 and FIG. 6, each grounding elastic member 8 is provided with a reserved hole 82 corresponding to the terminal slots 621 of each wall portion 62, and the front ends of the elastic contact portions 71 are exposed to the reserved holes 82, thus preventing short circuiting caused by the elastic contact portion 71 being in contact with the grounding elastic member 8 when being pushed by the tongue 13 to be elastically displaced toward a direction away from the mating space 61. The elastic contact portion 71 of each second ground terminal 712 is accommodated in the terminal slot 621 at the outermost side of each wall portion 62, and each grounding elastic member 8 has two connecting portions provided at two sides of the reserved hole 82 to cover the terminal slot 621 at the outermost side of each wall portion 62. The ground terminal and the connecting portion are overlapped in the thickness direction of each wall portion 62. The front end of the grounding elastic member 8 is provided with at least one first grounding portion 83 located between every two adjacent elastic portions 81. In the present embodiment, there are two first grounding portions 83, and the two first grounding portions 83 are formed by puncturing a plate body of the grounding elastic member 8. A rear end of the grounding elastic member 8 is provided with multiple second grounding portions 84. Each first grounding portion 83 and each second grounding portion 84 are formed by extending obliquely toward a direction away from the mating space 61 respectively, and are both in contact with the shielding shell 9, thus forming a firm contact between the grounding elastic member 8 and the shielding shell 9.

As shown in FIG. 1, FIG. 4 and FIG. 5, a shielding shell 9 is sleeved over the plastic seat body 6 and completely covers the wall portion 62. The grounding elastic member 8 is installed on the wall portion 62 and sandwiched between the wall portion 62 and the shielding shell 9, and the grounding elastic member 8, the first grounding portion 83 and the second contact portion are in contact with the inner wall surface of the shielding shell 9 respectively, thus forming a stable contact between the grounding sheet 4 and the shielding shell 9. A periphery of the front end of the shielding shell 9 bends toward the mating space 61 to form a flange 93. An outer surface of the plastic seat body 6 is concavely provided with a concave portion 624 in a circle. The flange 93 is correspondingly located in the concave portion 624 to position the front end of the shielding shell 9. A front end surface of the flange 93 extends forward beyond a front end surface of the plastic seat body 6 along the mating direction, such that the shielding shell 9 can be conductive to the metal shell 5 at the beginning of insertion into the insertion space 51 to ground the shielding shell 9. Thus, the grounding elastic member 8 can be grounded in time at the beginning of insertion of the mating connector 200 into the insertion space 51. The outer wall surface of the shielding shell 9 includes a top surface 91 and a bottom surface 92 opposite to each other, and two side surfaces (not labeled) respectively connected to the top surface 91 and the bottom surface 92. The top surface 91, the bottom surface 92 and the two side surfaces form an accommodating chamber (not labeled) for accommodating the plastic seat body 6.

Figure 9:
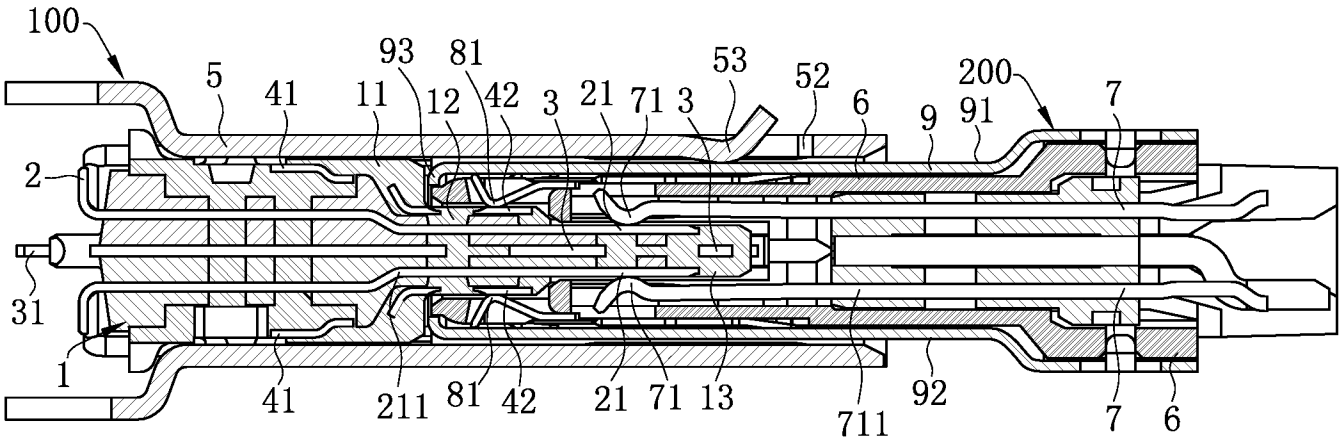
FIG. 9 is a schematic view of the electrical connector and the mating connector under a second mating state in an electrical connector assembly according to one embodiment of the present invention.
Figure 10:
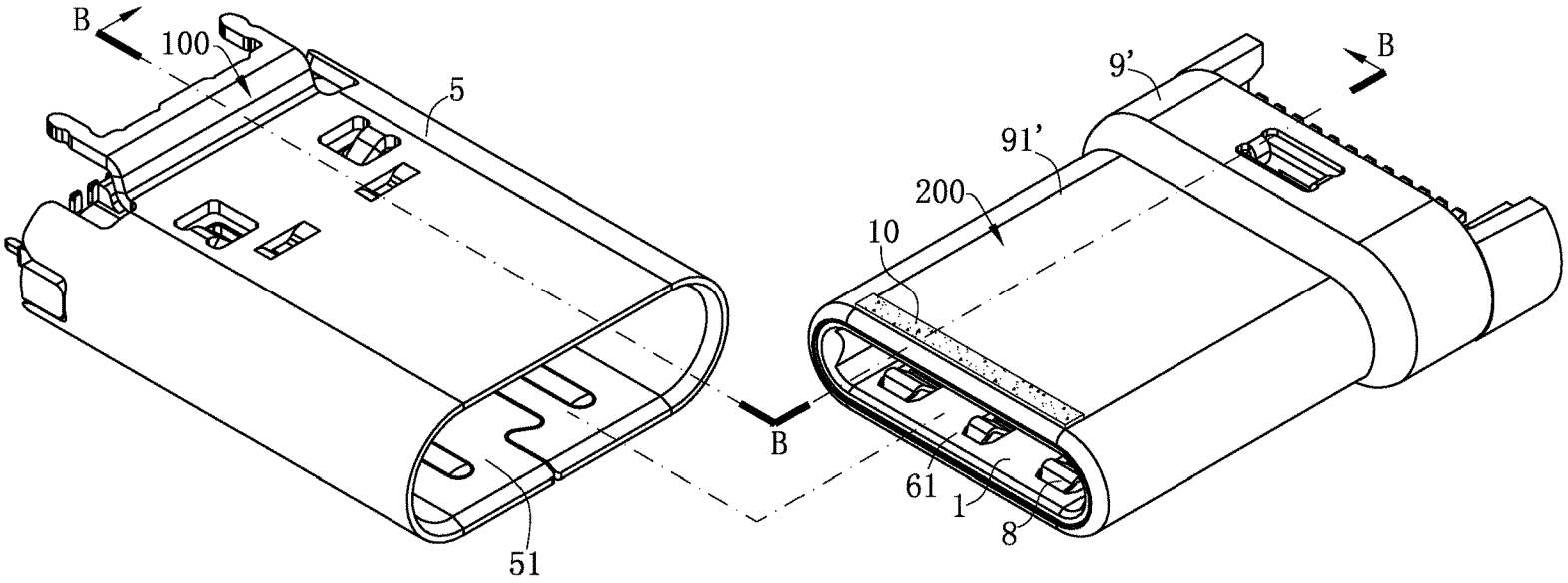
FIG. 10 is a schematic view of the electrical connector not mated with the mating connector in the electrical connector assembly according to a second embodiment of the present invention.
Figure 11:
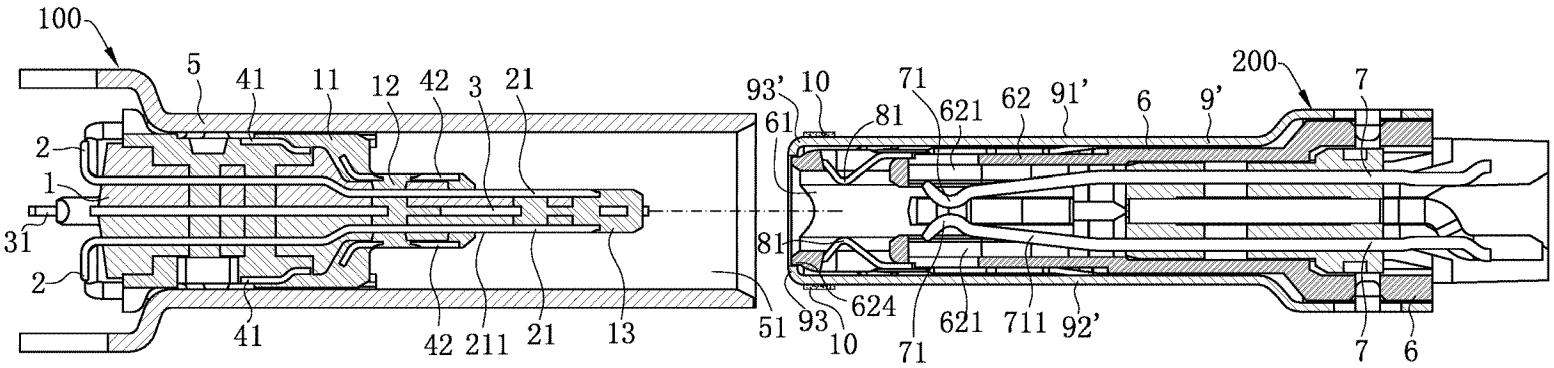
FIG. 11 is a sectional view in a direction B-B in FIG. 10.
Figure 12:
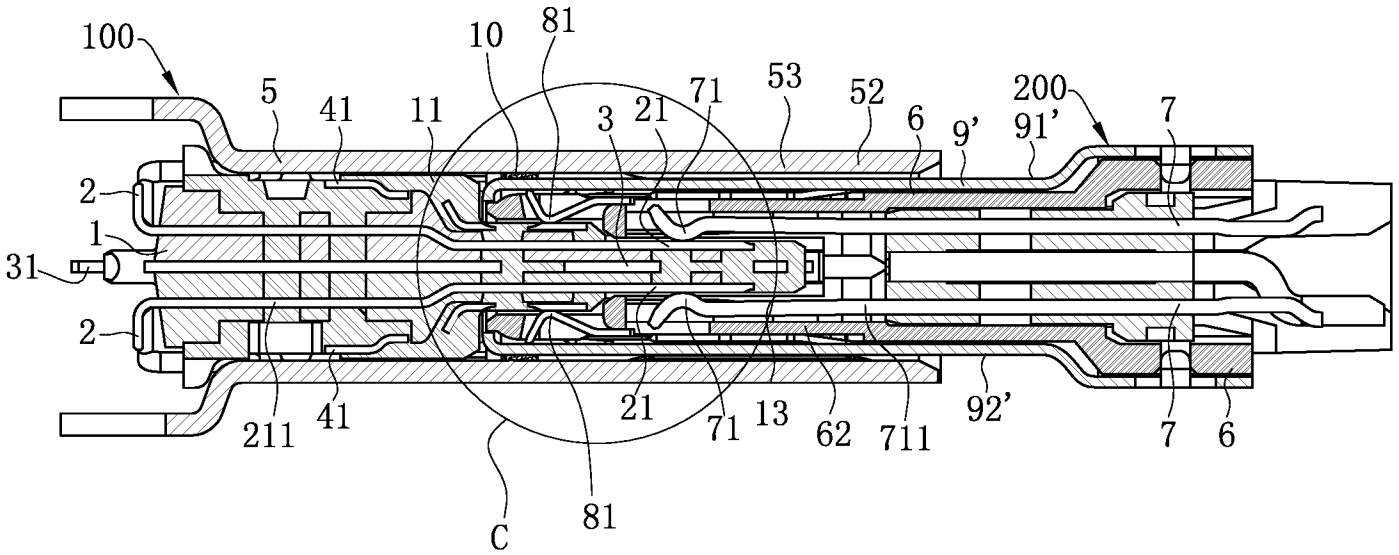
FIG. 12 is a schematic view of the electrical connector and the mating connector in a second mating state in FIG. 11.
Figure 13:
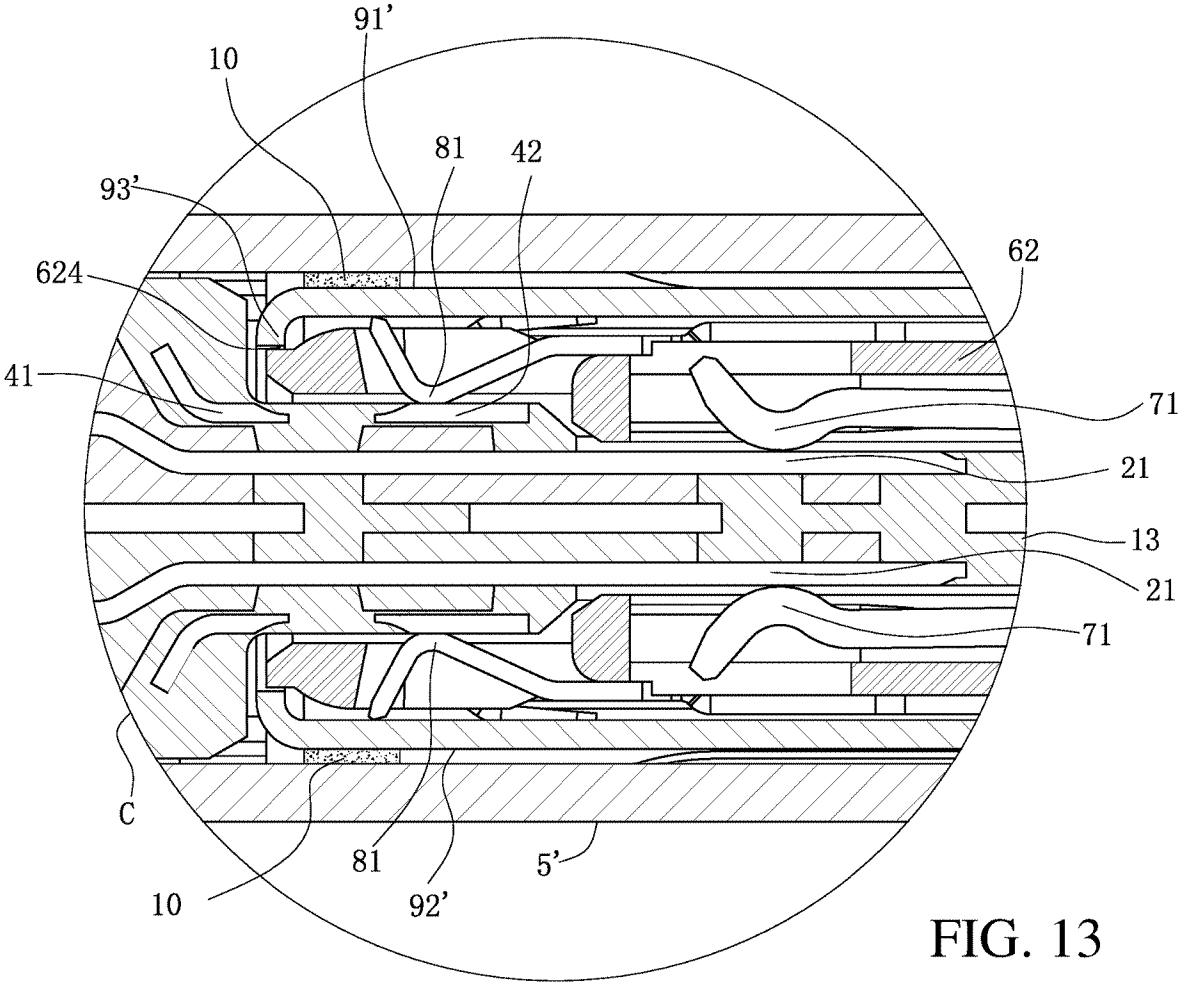
FIG. 13 is an enlarged view of a part C in FIG. 12.

As shown in FIG. 1, FIG. 6 and FIG. 7, FIG. 6 is a structural schematic view of an electrical connector 100 not mated with a mating connector 200 in an electrical connector assembly from a top viewing angle, and both the metal shell 5 and the shielding shell 9 in FIG. 6 are local sections. When the electrical connector 100 and the mating connector 200 are mated along the mating direction, the protruding portions 54 on the top and bottom walls of the metal shell 5 guide the shielding shell 9 to smoothly enter the insertion space 51, thus avoiding inclined insertion of the mating connector 200. Moreover, the tongue 13 is inserted into the mating space 61 simultaneously. Thus, in a mutual mating process of the electrical connector 100 and the mating connector 200, the electrical connector 100 and the mating connector 200 have a first mating state. As shown in FIG. 8, in the first mating state, the mating space 61 and the insertion space 51 are partially overlapped, and the elastic portion 81 is not in contact with the extending sheet 42. The front end of the shielding shell 9 is in contact with the elastic arm 53 of the metal shell 5 to form grounding, and a gap is provided between the grounding elastic member 8 and the first signal terminal 211. The second terminals 7 are not in contact with the first terminals 2. That is, the shielding shell 9 can be in direct contact with the metal shell 5 in the first mating state, so the shielding shell 9 is grounded. The grounding elastic member 8 is in contact with the shielding shell 9 so as to be grounded in time in the first mating state. Even if the grounding elastic member 8 is in contact with the signal terminals due to inclined insertion of the mating connector 200 into the insertion space 51, the grounding elastic member 8 has been grounded and a gap is provided between the grounding elastic member 8 and the first signal terminal 211, thereby preventing the first signal terminal 211 from being short-circuited, and a signal chip on the circuit board from being burnt down. When the electrical connector 100 and the mating connector 200 are completely inserted, the electrical connector 100 and the mating connector 200 have a second mating state. As shown in FIG. 9, the shielding shell 9 always urges against the elastic arm 53 of the metal shell 5 and pushes the elastic arm 53 to a horizontal state. The front end of the elastic arm 53 protrudes from the opening hole 52 and is located outside the insertion space 51, and the second terminals 7 are in one-to-one elastic contact with the first terminals 2. Specifically, the elastic contact portions 71 of the two pairs of second signal terminals 711 are in contact with the flat contact portions 21 of the two pairs of first signal terminals 211. The elastic contact portions 71 of the second low-speed terminals 713, the second reserved terminals 714, the second power terminals 715 and the second ground terminals 712 elastically urge against the flat contact portions 21 of the first low-speed terminals 213, the first reserved terminals 214, the first power terminals 215 and the first ground terminals 212 correspondingly in a one-to-one manner respectively. That is, in the second mating state, the elastic contact portions 71 in the upper row and the lower row and the flat contact portions 21 in the upper row and the lower row are in one-to-one correspondence contact, thus forming a good electrical connection between the electrical connector 100 and the mating connector 200. Moreover, in the second mating state, the front end surface of the flange 93 urges against the front end surface of the base 11, such that the mating connector 200 and the electrical connector 100 are inserted in place, and the elastic portion 81 elastically urges against the extending sheet 42. That is, the elastic portions 81 of the two grounding elastic members 8 penetrate through the through holes 622 respectively and elastically clamp the two extending sheets 42 in a vertical direction. In this way, the grounding elastic member 8 is grounded, and a retaining force between the electrical connector 100 and the mating connector 200 is enhanced. The latch portions H1 are correspondingly fastened by the buckling portions 32 to enhance an insertion and pulling force between the electrical connector 100 and the mating connector 200, thus ensuring a stable electrical connection between the electrical connector 100 and the mating connector 200.

In the present embodiment, a gap is provided between the outer wall surface of the shielding shell 9 and the inner wall surface of the metal shell 5, an elastic arm 53 integrally extends from the metal shell 5, and the shielding shell 9 is grounded by contacting with the elastic arm 53. In other embodiments, the metal shell 5 may not be provided with the elastic arm 53, the gap is not provided between the outer wall surface of the shielding shell 9 and the inner wall surface of the metal shell 5, and the shielding shell 9 is grounded by contacting with the inner wall surface of the metal shell 5, as long as it is ensured that the shielding shell 9 can be conductive to the metal shell 5 to be grounded.

FIG. 10 to FIG. 13 show a second embodiment of the present invention, which is different from the first embodiment in that: the opening hole 52 and the elastic arm 53 are not provided on a top wall of a metal shell 5', and the outer wall surface of a shielding shell 9' is provided with at least one electrical conductor 10. That is, the electrical conductor 10 is in contact with the shielding shell 9'. In the first mating state, the electrical conductor 10 enters the insertion space 51 to be in contact with the metal shell 5', such that the shielding shell 9' is conductive to the metal shell 5' through the electrical conductor 10 so as to achieve a grounding effect. In the present embodiment, there are two electrical conductors 10, and each of a top surface 91' and a bottom surface 92' of the shielding shell 9' is provided with one of the two electrical conductors 10. A hardness of each of the two electrical conductors 10 is smaller than that of the shielding shell 9', and each of the two electrical conductors 10 extends forward beyond the front end of the grounding elastic member 8 along the mating direction. In the present embodiment, the two electrical conductors 10 are adhered to the top surface 91' and the bottom surface 92' of the shielding shell 9', and the two electrical conductors 10 are formed by conductive flexible glue. In other embodiments, the electrical conductors 10 may be formed by conductive sponges. The hardness of each of the two electrical conductors 10 is smaller than that of the shielding shell 9' so as to make it convenient for the shielding shell 9' to be smoothly inserted into an insertion space 51', thus avoiding damage to the metal shell 5' caused by hit of the electrical conductor 10 against the inner wall surface of the metal shell 5'. In the first mating state and the second mating state, each of the two electrical conductors 10 is in contact with the shielding shell 9', such that the shielding shell 9' is always conductive to the metal shell 5'. Thus, the shielding shell 9' can be conductive to the metal shell 5' in the first mating state likewise to ground the shielding shell 9', so the grounding elastic member 8 can be grounded in time, thereby preventing the first signal terminal 211 from being short-circuited and a signal chip on a circuit board from being burnt down.

Figure 14:
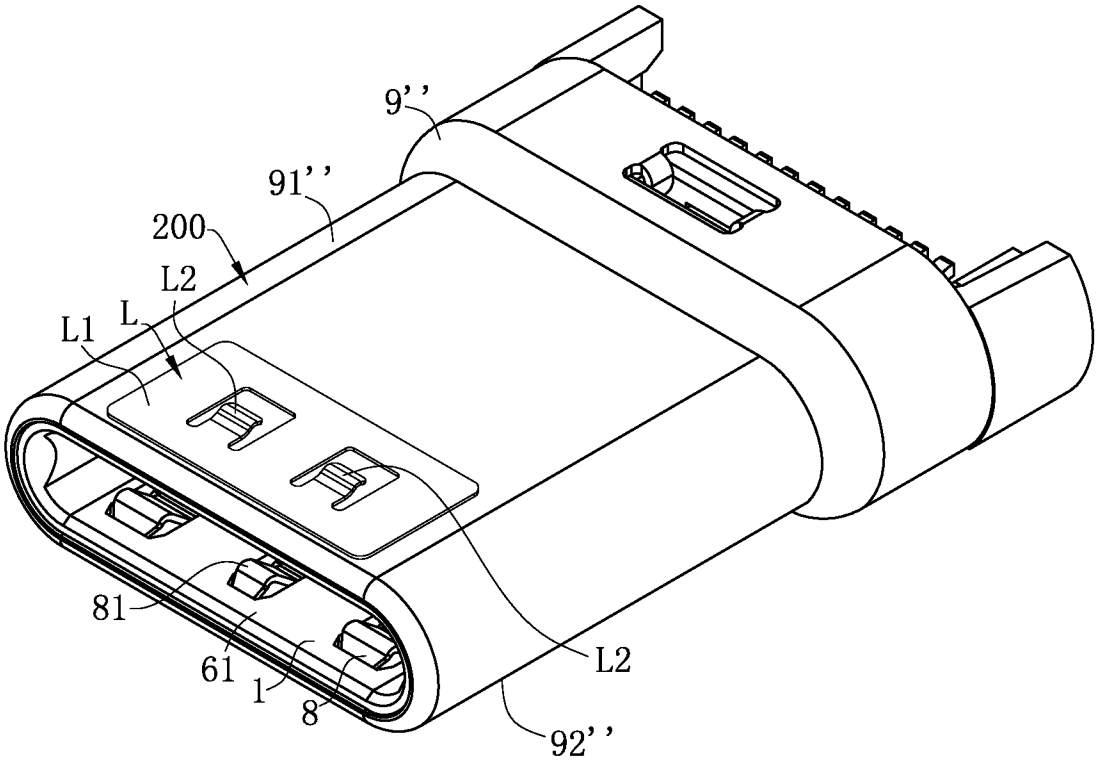
FIG. 14 is a three-dimensional assembled view of the mating connector according to a third embodiment of the present invention.

FIG. 14 shows a third embodiment of the present invention, which is different from the first embodiment in that at least one electrical conductor L is provided on the outer wall surface of a shielding shell 9". In the present embodiment, the electrical conductor L is a metal elastic member. Each of a top surface 91" and a bottom surface 92" of the shielding shell 9" is provided with an electrical conductor L. Each electrical conductor L has a fixed plate L1 and an elastic member L2 formed by tearing from the fixed plate L1. A front end of the fixed plate L1 extends forward beyond a front end of the grounding elastic member 8 along the mating direction, and the two fixed plates L1 are soldered and fixed to the top surface 91" and the bottom surface 92" of the shielding shell 9" respectively. In the first mating state, the fixed plate L1 is in contact with the inner wall of the metal shell 5, and the shielding shell 9" are conductive to the metal shell 5 through the elastic member L2. In the second mating state, the fixed plate L1 and the elastic member L2 are both in contact with the inner wall surface of the metal shell 5. That is, the shielding shell 9" remains in conduction with the metal shell 5 in the second mating state, so the shielding shell 9" can be conductive to the metal shell 5 in the first mating state likewise to ground the shielding shell 9". Accordingly the grounding elastic member 8 can be grounded in time, thereby preventing the first signal terminal 211 from being short-circuited and a signal chip on a circuit board from being burnt down. In the present embodiment, the electrical conductor L is a metal elastic member. In other embodiments, the electrical conductor L may be a metal ring, which is fixedly sleeved over the outer wall surface of the shielding shell 9". In the first mating state and the second mating state, the metal ring is in contact with the inner wall surface of the metal shell 5, and the shielding shell 9" is conductive to the metal shell 5 through the metal ring.

Compared with the prior art, the electrical connector assembly according to certain embodiments of the present invention has the following beneficial effects.

(1) The electrical connector 100 and the mating connector 200 have the first mating state, in which the mating space 61 and the insertion space 51 are partially overlapped, the elastic portion 81 is not in contact with the extending sheet 42, the front end of the shielding shell 9 is in contact with the elastic arm 53 of the metal shell 5 to form grounding, a gap is provided between the grounding elastic member 8 and the first signal terminal 211, and the second signal terminal 711 is not in contact with the first signal terminal 211. That is, the shielding shell 9 can be in direct contact with the metal shell 5 in the first mating state, so the shielding shell 9 is grounded. The grounding elastic member 8 is in contact with the shielding shell 9 so as to be grounded in time in the first mating state. Even if the grounding elastic member 8 is in contact with the first signal terminal 211 due to inclined insertion of the mating connector 200 into the insertion space 51, the grounding elastic member 8 has been grounded and a gap is provided between the grounding elastic member 8 and the first signal terminal 211, thereby preventing the first signal terminal 211 from being short-circuited, and a signal chip on the circuit board from being burnt down.

(2) The front end surface of the flange 93 urges against the front end surface of the base 11, such that the mating connector 200 and the electrical connector 100 are inserted in place, and the elastic portion 81 elastically urges against the extending sheet 42. That is, the elastic portions 81 of the two grounding elastic members 8 penetrate through the through holes 622 respectively and elastically clamp the two extending sheets 42 in a vertical direction. In this way, the grounding elastic member 8 grounded, and a retaining force between the electrical connector 100 and the mating connector 200 is enhanced. The latch portions H1 are correspondingly fastened by the buckling portions 32 to enhance an insertion and pulling force between the electrical connector 100 and the mating connector 200, thus ensuring a stable electrical connection between the electrical connector 100 and the mating connector 200.

(3) Each protruding portion 54 extends forward beyond the front end of the elastic arm 53 along the mating direction. During mating with the mating connector 200, the shielding shell 9 of the mating connector 200 is in contact with the protruding portion 54 of the metal shell 5, and is guided by the protruding portions 54 to be in contact with the elastic arm 53. Thus, the protruding portions 54 are provided for good positioning of the shielding shell 9 of the mating connector 200 in the insertion space 51, and are capable of preventing the elastic arm 53 from being damaged by a direct contact between the shielding shell 9 of the mating connector 200 and the tail end of the elastic arm 53.

(4) Each grounding elastic member 8 is provided with a reserved hole 82 corresponding to the terminal slots 621 of each wall surface 62, and the front ends of the elastic contact portions 71 are exposed to the reserved holes 82, thus preventing short circuiting caused by the elastic contact portion 71 being in contact with the grounding elastic member 8 when being pushed by the tongue 13 to be elastically displaced toward a direction away from the mating space 61.

(5) A central line of the elastic arm 53 along the mating direction coincides with a central line of the top wall of the metal shell 5 along the mating direction. That is, the elastic arm 53 is located at a middle position of the metal shell 5. Even if the mating connector 200 is inserted into the insertion space 51 along a deviated insertion direction, it can be ensured that the elastic arm 53 is into contact with the shielding shell 9 of the mating connector 200 smoothly.

(6) The hardness of the electrical conductor 10 is smaller than that of the shielding shell 9' so as to make it convenient for the shielding shell 9' to be smoothly inserted into the insertion space 51', thus avoiding damage to the metal shell 5' caused by hit of the electrical conductor 10 against the inner wall surface of the metal shell 5', and allowing the shielding shell 9' to be easily inserted.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector assembly, comprising:

an electrical connector, comprising an insulating body, the insulating body having a base and a tongue extending forward from the base, wherein at least one first signal terminal is fixedly provided on the base and exposed to a surface of the tongue, a metal shell is sleeved over the base and the tongue, an insertion space is formed between the metal shell and the tongue, and the at least one first signal terminal is exposed to the insertion space; and a mating connector, comprising a plastic seat body, the plastic seat body having a mating space, wherein a wall portion is provided at one side of the mating space, at least one second signal terminal is fixedly provided on the plastic seat body and extending into the mating space, a grounding elastic member is fixedly provided on the wall portion and exposed to the mating space, a shielding shell is sleeved over the plastic seat body, and the grounding elastic member is in contact with the shielding shell, wherein the electrical connector is provided with a first mating state and a second mating state when being mated with the mating connector along a mating direction, wherein in the first mating state, the shielding shell partially enters the insertion space, the shielding shell is conductive to the metal shell, a gap is provided between the grounding elastic member and the at least one first signal terminal, and the at least one second signal terminal is not in contact with the at least one first signal terminal; and wherein in the second mating state, the tongue is inserted into the mating space, the shielding shell is conductive to the metal shell, and the at least one second signal terminal is in contact with the at least one first signal terminal.

2. The electrical connector assembly according to claim 1, wherein the insulating body is provided with a step portion between the base and the tongue, a thickness of the step portion is greater than a thickness of the tongue, a grounding sheet covers a surface of the step portion, and the grounding sheet is in contact with the metal shell, wherein in the second mating state, the grounding sheet is located in the mating space and is in contact with the grounding elastic member.

3. The electrical connector assembly according to claim 2, wherein:

the grounding sheet has a fixing portion fixed to the base;

an extending sheet extends forward from the fixing portion integrally and is exposed to the surface of the step portion;

at least one through hole is formed by penetrating through the wall portion along a thickness direction thereof;

a front end of the grounding elastic member has at least one elastic portion passing through the through hole and exposed to the mating space;

in the first mating state, the mating space and the insertion space are partially overlapped, and the elastic portion is not in contact with the extending sheet; and in the second mating state, the elastic portion elastically urges against the extending sheet.

4. The electrical connector assembly according to claim 3, wherein:

the fixing portion is insert-molded into the base;

two extending sheets extend forward from an upper side and a lower side of the fixing portion and are exposed to an upper surface and a lower surface of the step portion, respectively;

the plastic seat body is provided with two wall portions at two opposite sides of the mating space respectively;

two grounding elastic members are installed at outer sides of the two wall portions, respectively; and in the second mating state, the elastic portions of the two grounding elastic members pass through the through holes respectively and elastically clamp the two extending sheets along a vertical direction.

5. The electrical connector assembly according to claim 3, wherein:

the front end of the grounding elastic member is provided with at least one first grounding portion, and the at least one first grounding portion is located between two adjacent ones of the elastic portions;

a rear end of the grounding elastic member is provided with a plurality of second grounding portions; and the at least one first grounding portion and each of the second grounding portions are formed by extending obliquely toward a direction away from the mating space respectively, and are in contact with the shielding shell.

6. The electrical connector assembly according to claim 3, wherein:

the mating connector has at least two pairs of second signal terminals arranged in a same row, and each of the second signal terminals is a differential signal terminal;

the grounding elastic member has three elastic portions arranged side by side and protruding into the mating space; and two elastic portions located at two sides of the grounding elastic member are correspondingly located right ahead of the two pairs of second signal terminals along the mating direction.

7. The electrical connector assembly according to claim 6, wherein the mating connector further comprises at least one pair of low-speed signal terminals fixedly provided on the plastic seat body and extending into the mating space, the low-speed signal terminals are located between the two pairs of second signal terminals, and the elastic portion at a middle position of the grounding elastic member is located right ahead of the low-speed signal terminals along the mating direction.

8. The electrical connector assembly according to claim 1, wherein:

an opening hole is provided on a top wall of the metal shell;

an elastic arm is formed by extending forward from a rear edge of the opening hole integrally along the mating direction and bending toward the insertion space;

the elastic arm protrudes into the insertion space;

a central line of the elastic arm along the mating direction coincides with a central line of the top wall of the metal shell along the mating direction; and in the first mating state and the second mating state, the elastic arm is in contact with the shielding shell.

9. The electrical connector assembly according to claim 8, wherein the top wall of the metal shell is provided with at least one protruding portion protruding toward the insertion space at each of two sides of the elastic arm, and a front end of the protruding portion extends forward beyond a front end of the elastic arm along the mating direction.

10. The electrical connector assembly according to claim 9, wherein the protruding portion is a strip-shaped rib, and a length of the protruding portion along the mating direction is greater than a length of the elastic arm along the mating direction.

11. The electrical connector assembly according to claim 9, wherein the top wall of the metal shell is provided with two protruding portions protruding toward the insertion space at each of the two sides of the elastic arm, each of the protruding portions is bulged, and a distance between the two protruding portions at a same side of the elastic arm is greater than a length of the elastic arm.

12. The electrical connector assembly according to claim 1, wherein a periphery of a front end of the shielding shell bends toward the mating space to form a flange, an outer surface of the plastic seat body is concavely provided with a concave portion, the flange is correspondingly located in the concave portion, a front end surface of the flange extends forward beyond a front end surface of the plastic seat body along the mating direction, and in the second mating state, the front end surface of the flange urges against a front end surface of the base.

13. The electrical connector assembly according to claim 1, wherein at least one electrical conductor is provided on an outer wall surface of the shielding shell, and in the first mating state, the at least one electrical conductor enters the insertion space and is in contact with the metal shell.

14. The electrical connector assembly according to claim 13, wherein:

the outer wall surface of the shielding shell comprises a top surface and a bottom surface opposite to each other, and two side surfaces respectively connected to the top surface and the bottom surface;

the at least one electrical conductor comprises two electrical conductors, and each of the top surface and the bottom surface is provided with one of the two electrical conductors;

a hardness of each of the two electrical conductors is smaller than a hardness of the shielding shell; and a front end of each of the two electrical conductors extends forward beyond a front end of the grounding elastic member along the mating direction.

15. The electrical connector assembly according to claim 14, wherein the two electrical conductors are adhered to the top surface and the bottom surface of the shielding shell, and each of the electrical conductors is formed by conductive flexible glue or a conductive sponge.

16. The electrical connector assembly according to claim 13, wherein the electrical conductor is a metal elastic member or a metal ring, a front end of the electrical conductor extends forward beyond a front end of the grounding elastic member along the mating direction, and the electrical conductor is soldered or sleeved onto the outer wall surface of the shielding shell.

17. The electrical connector assembly according to claim 1, wherein:

the electrical connector has four pairs of first signal terminals arranged on an upper surface and a lower surface of the tongue respectively to form an upper row and a lower row, and each of the first signal terminals is a differential signal terminal;

at least one first ground terminal is provided at an outermost side of the first signal terminals in each row of the electrical connector;

each of the first signal terminals in each row and the at least one first ground terminal have a flat contact portion exposed to the insertion space, respectively;

a middle shielding member is insert-molded into the tongue and located between the first signal terminals in the upper row and the lower row; and two side edges of the middle shielding member are respectively concavely provided with buckling portions protruding out of two opposite sides of the tongue.

18. The electrical connector assembly according to claim 17, wherein:

the mating space is concavely provided backward from a front end of the plastic seat body;

the mating connector has four pairs of second signal terminals fixedly provided on the plastic seat body and arranged at an upper side and a lower side of the mating space respectively to form an upper row and a lower row;

a second ground terminal is provided at an outer side of each pair of second signal terminals of the mating connector, and is fixedly provided on the plastic seat body and protrudes into the mating space;

each of the second signal terminals and each second ground terminal have an elastic contact portion located in the mating space respectively;

a latch member is installed on the plastic seat body and located between the second signal terminals in the upper row and the lower row;

the latch member has a pair of elastic latch portions extending along the mating direction and entering the mating space; and in the second mating state, the elastic contact portions in the upper row and the lower row are in one-to-one corresponding contact with the flat contact portions in the upper row and the lower row, and the latch portions are correspondingly buckled to the buckling portions.

19. The electrical connector assembly according to claim 18, wherein:

the plastic seat body is provided with two wall portions at the upper side and lower side of the mating space respectively;

each of the two wall portions is provided with a plurality of terminal slots penetrating therethrough along a thickness direction thereof and communicated with the mating space;

in the second mating state, the elastic contact portions are correspondingly accommodated in the terminal slots;

two grounding elastic members are respectively installed on the two wall portions, and each of the two grounding elastic members is provided with a reserved hole corresponding to the terminal slots of each of the two wall portions; and front ends of the elastic contact portions are exposed to the reserved holes.

20. The electrical connector assembly according to claim 19, wherein the elastic contact portion of each of the second ground terminals is accommodated in the terminal slot at an outermost side of each wall portion, each grounding elastic member has two connecting portions provided at two sides of the reserved hole thereof to cover the terminal slot at the outermost side of each wall portion, and the second ground terminals and the connecting portions are overlapped in the thickness direction of each wall portion.

* * * * *